US012565890B2

(12) United States Patent
De Bock et al.

(10) Patent No.: US 12,565,890 B2
(45) Date of Patent: Mar. 3, 2026

(54) SYSTEM AND METHOD FOR CLEANING A LIQUID RING PUMP SYSTEM

(71) Applicant: Edwards Technologies Vacuum Engineering (Qingdao) Company Limited, Shandong (CN)

(72) Inventors: Andries Daniel Jozef De Bock, Cologne (DE); Bart Van Audenrode, Michigan City, MI (US); Xin Dai, Shandong (CN); Xibo Liu, Shandong (CN); Kun Zhou, Shandong (CN)

(73) Assignee: Edwards Technologies Vacuum Engineering (Qingdao) Company Limited, Qingdao (CN)

( * ) Notice: Subject to any disclaimer, the term of this patent is extended or adjusted under 35 U.S.C. 154(b) by 0 days.

(21) Appl. No.: 18/835,236

(22) PCT Filed: Feb. 17, 2023

(86) PCT No.: PCT/IB2023/051444
§ 371 (c)(1),
(2) Date: Aug. 1, 2024

(87) PCT Pub. No.: WO2023/156951
PCT Pub. Date: Aug. 24, 2023

(65) Prior Publication Data

US 2025/0163915 A1 May 22, 2025

(30) Foreign Application Priority Data

Feb. 17, 2022 (WO) ..... PCT/CN2022/076594

(51) Int. Cl.
*F04C 19/00* (2006.01)
*F04C 28/24* (2006.01)

(52) U.S. Cl.
CPC ..... *F04C 19/004* (2013.01); *F04C 28/24* (2013.01); *F04C 19/005* (2013.01)

(58) Field of Classification Search
CPC ..... F04C 19/004; F04C 28/24; F04C 19/005
See application file for complete search history.

(56) References Cited

U.S. PATENT DOCUMENTS 3,289,918 A * 12/1966 Adams ..... F04C 19/004 417/68
2015/0275897 A1* 10/2015 Field ..... F04C 28/24 418/100

(Continued)

FOREIGN PATENT DOCUMENTS

CN 204923937 U 12/2015
CN 110043465 A 7/2019

(Continued)

OTHER PUBLICATIONS

Chinese Patent Publication and Machine Translation for CN 209800272 U; 1st Inventor: Yang; Title: A Suitable Reflux Adjusting Device for Liquid Ring Pump; Published: Dec. 17, 2019. (Year: 2019).*

(Continued)

*Primary Examiner* — Mary A Davis
(74) *Attorney, Agent, or Firm* — Theodore M. Magee; Westman, Champlin & Koehler, P.A.

(57) ABSTRACT

A system comprising: a liquid ring pump; a separator coupled to an exhaust outlet of the liquid ring pump; a valve module, the valve module being coupled to the separator via a first drainage line and coupled to the liquid ring pump via a second drainage line, the valve module comprising a first valve arranged along the first drainage line and a second valve arranged along the second drainage line; and a controller configured to control the valves.

13 Claims, 6 Drawing Sheets

(56) References Cited

U.S. PATENT DOCUMENTS

| | | | | |
|---|---|---|---|---|
| 2021/0010474 | A1* | 1/2021 | Coeckelbergs | F04C 28/24 |
| 2021/0017989 | A1* | 1/2021 | De Bock | F04C 19/004 |

FOREIGN PATENT DOCUMENTS

| | | | |
|---|---|---|---|
| CN | 209800272 | U | 12/2019 |
| DE | 662514 | | 7/1938 |
| EP | 1762728 | A1 | 3/2007 |
| GB | 1011451 | | 12/1965 |
| GB | 2540582 | A | 7/2015 |
| JP | S5949388 | A | 3/1984 |
| WO | 2019175819 | A1 | 9/2019 |

OTHER PUBLICATIONS

British Combined Search and Examination Report dated Aug. 11, 2022 and Search Report dated Aug. 10, 2022 for corresponding British application Serial No. GB2203388.0, 7 pages.
PCT Notification of Transmittal of the International Search Report and the Written Opinion of the International Searching Authority of the Declaration and PCT International Search Report dated May 19, 2023 for PCT application Serial No. PCT/IB2023/051444, 6 pages.
PCT International Written Opinion dated May 19, 2023 for PCT application Serial No. PCT/IB2023/051444, 7 pages.

* cited by examiner

SYSTEM AND METHOD FOR CLEANING A LIQUID RING PUMP SYSTEM

CROSS-REFERENCE OF RELATED APPLICATION

This application is a Section 371 National Stage Application of International Application No. PCT/IB2023/051444, filed Feb. 17, 2023, and published as WO 2023/156951A1 on Aug. 24, 2023, the content of which is hereby incorporated by reference in its entirety and which claims priority of Chinese Application No. PCT/CN2022/076594, filed Feb. 17, 2022.

FIELD

The present invention relates to the cleaning of pumping systems comprising liquid ring pumps and separators.

BACKGROUND

Liquid ring pumps are a known type of pump which are typically commercially used as vacuum pumps and as gas compressors. Liquid ring pumps typically include a housing with a chamber therein, a shaft extending into the chamber, an impeller mounted to the shaft, and a drive system such as a motor operably connected to the shaft to drive the shaft. The impeller and shaft are positioned eccentrically within the chamber of the liquid ring pump.

In operation, the chamber is partially filled with an operating liquid (also known as a service liquid). When the drive system drives the shaft and the impeller, a liquid ring is formed on the inner wall of the chamber, thereby providing a seal that isolates individual volumes between adjacent impeller vanes. The impeller and shaft are positioned eccentrically to the liquid ring, which results in a cyclic variation of the volumes enclosed between adjacent vanes of the impeller and the liquid ring.

In a portion of the chamber where the liquid ring is further away from the shaft, there is a larger volume between adjacent impeller vanes which results in a smaller pressure therein. This allows the portion where the liquid ring is further away from the shaft to act as a gas intake zone. In a portion of the chamber where the liquid ring is closer to the shaft, there is a smaller volume between adjacent impeller vanes which results in a larger pressure therein. This allows the portion where the liquid ring is closer to the shaft to act as a gas discharge zone.

During operation of the liquid ring pump, the operating liquid may become contaminated over time. For example, particulate matter may become suspended or carried in the operating liquid, and/or substances may dissolve into the operating liquid which may make the operating liquid corrosive. Such contamination may reduce efficiency, reliability and lifetime of the liquid ring pump and/or other components of the pumping system in which the liquid ring pump is implemented.

The discussion above is merely provided for general background information and is not intended to be used as an aid in determining the scope of the claimed subject matter. The claimed subject matter is not limited to implementations that solve any or all disadvantages noted in the background.

SUMMARY

In an aspect, there is provided a system comprising: a liquid ring pump comprising a chamber, a suction inlet, and an exhaust outlet, wherein the liquid ring pump is configured to pump an inlet fluid into the chamber via the suction inlet, and pump an exhaust fluid out of the chamber via the exhaust outlet; a separator coupled to the exhaust outlet of the liquid ring pump and configured to separate the exhaust fluid received from the liquid ring pump into gas and liquid; a valve module, wherein the valve module is coupled to the separator via a first drainage line, the valve module is coupled to the liquid ring pump via a second drainage line, and the valve module comprises a first valve arranged along the first drainage line and a second valve arranged along the second drainage line; and a controller configured to: for some time while the liquid ring pump is pumping the exhaust fluid to the separator, control the first valve such that a liquid within the separator is permitted to flow out of the separator via the first drainage line; and for some time while the liquid ring pump is not pumping the exhaust fluid to the separator, either or both of control the first valve such that a liquid within the separator is permitted to flow out of the separator via the first drainage line, or control the second valve such that a liquid within the liquid ring pump is permitted to flow out of the liquid ring pump via the second drainage line.

The system may further comprise a timer configured to output a timer signal at a first predetermined time interval. The controller may be further configured to, while the liquid ring pump is pumping the exhaust fluid to the separator, responsive to the timer outputting the timer signal, control the first valve such that a liquid within the separator is permitted to flow out of the separator via the first drainage line for a second predetermined time interval, the second predetermined time interval being shorter than the first predetermined time interval.

The system may further comprise a liquid inlet line coupled to the separator via which a liquid can be introduced into the separator, and a third valve arranged along the liquid inlet line. The controller may be further configured to, for some time while the liquid ring pump is pumping the exhaust fluid to the separator and the first valve is being controlled such that the liquid within the separator is permitted to flow out of the separator via the first drainage line, control the third valve such that liquid is permitted to flow into the separator via the liquid inlet line. The controller may be further configured to, for some time while the liquid ring pump is not pumping the exhaust fluid to the separator, control the third valve such that liquid is permitted to flow into the separator via the liquid inlet line.

The system may further comprise a further pump coupled between the separator and the liquid ring pump and configured to pump liquid from the separator to the liquid ring pump. The controller may be further configured to control the further pump.

One or both of the first valve or the second valve may be a solenoid valve.

The first valve may have a greater Valve Flow Coefficient than the second valve.

In a further aspect, there is provided a control method for a system. The system comprises a liquid ring pump comprising a chamber, a suction inlet, and an exhaust outlet, the liquid ring pump being configured to pump an inlet fluid into the chamber via the suction inlet and pump an exhaust fluid out of the chamber via the exhaust outlet, a separator coupled to the exhaust outlet of the liquid ring pump and configured to separate the exhaust fluid received from the liquid ring pump into gas and liquid, and a valve module, the valve module being coupled to the separator via a first drainage line and to the liquid ring pump via a second drainage line, the valve module comprising a first valve arranged along the first drainage line and a second valve arranged along the second drainage line. The method comprises, for some time while the liquid ring pump is pumping the exhaust fluid to the separator, controlling, by a controller, the first valve thereby to cause a liquid within the separator to flow out of the separator via the first drainage line.

The method may further comprise, while the liquid ring pump is pumping the exhaust fluid to the separator, one or more times sequentially performing steps (i) to (iii), wherein: step (i) comprises outputting, by a timer, a timer signal responsive to a first predetermined time interval elapsing; step (ii) comprises, responsive to the timer outputting the timer signal, controlling, by the controller, the first valve thereby to cause the liquid within the separator to flow out of the separator via the first drainage line for a second predetermined time interval, the second predetermined time interval being shorter than the first predetermined time interval; and step (iii) comprises, responsive to the second predetermined time interval elapsing, controlling, by the controller, the first valve thereby to prevent the liquid within the separator from flowing out of the separator via the first drainage line.

The system may further comprise a liquid inlet line coupled to the separator via which a liquid can be introduced into the separator, and a third valve arranged along the liquid inlet line. The method may further comprise, for some time while the liquid ring pump is pumping the exhaust fluid to the separator and the first valve is being controlled such that the liquid within the separator is permitted to flow out of the separator via the first drainage line, controlling, by the controller, the third valve thereby to cause liquid to flow into the separator via the liquid inlet line.

In a further aspect, there is provided a control method for a system. The system comprises a liquid ring pump comprising a chamber, a suction inlet, and an exhaust outlet, the liquid ring pump being configured to pump an inlet fluid into the chamber via the suction inlet and pump an exhaust fluid out of the chamber via the exhaust outlet, a separator coupled to the exhaust outlet of the liquid ring pump and configured to separate the exhaust fluid received from the liquid ring pump into gas and liquid, and a valve module, the valve module being coupled to the separator via a first drainage line and to the liquid ring pump via a second drainage line, the valve module comprising a first valve arranged along the first drainage line and a second valve arranged along the second drainage line. The control method comprises, for some time while the liquid ring pump is not pumping the exhaust fluid to the separator, performing one or more actions selected from the group of actions consisting of: controlling, by a controller, the first valve thereby causing a liquid within the separator to flow out of the separator via the first drainage line; and controlling, by a controller, the second valve thereby to cause a liquid within the liquid ring pump to flow out of the liquid ring pump via the second drainage line.

The system may further comprise a liquid inlet line coupled to the separator via which a liquid can be introduced into the separator, a third valve arranged along the liquid inlet line, and a further pump coupled between the separator and the liquid ring pump. The method may further comprise, for some time while the liquid ring pump is not pumping the exhaust fluid to the separator, subsequent to the performing of the one or more actions: responsive to one or more criteria being satisfied, controlling, by the controller, the first valve to prevent liquid within the separator from flowing out of the separator via the first drainage line and controlling, by the controller, the second valve to prevent a liquid within the liquid ring pump from flowing out of the liquid ring pump via the second drainage line; controlling, by the controller, the third valve thereby to cause liquid to flow into the separator via the liquid inlet line; and controlling, by the controller, the further pump to pump the liquid from the separator to the liquid ring pump. The one or more criteria may be selected from the group of criteria consisting of: a first predetermined volume of water having flowed out of the separator via the first drainage line; a second predetermined volume of water having flowed out of the liquid ring pump via the second drainage line; a third predetermined volume of water having flowed out of the separator and the liquid ring pump via the first and second drainage lines; the first valve having been opened for a first predetermined time period; the second valve having been opened for a second predetermined time period; the first valve and the second valve having been opened at the same time for a third predetermined time period.

In a further aspect, there is provided a program or plurality of programs arranged such that, when executed by a computer system or one or more processors of a controller, it/they cause/s the controller to operate in accordance with the method of any preceding aspect.

In a further aspect, there is provided a machine-readable storage medium storing a program or at least one of the plurality of programs according to the preceding aspect.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

Figure 1:
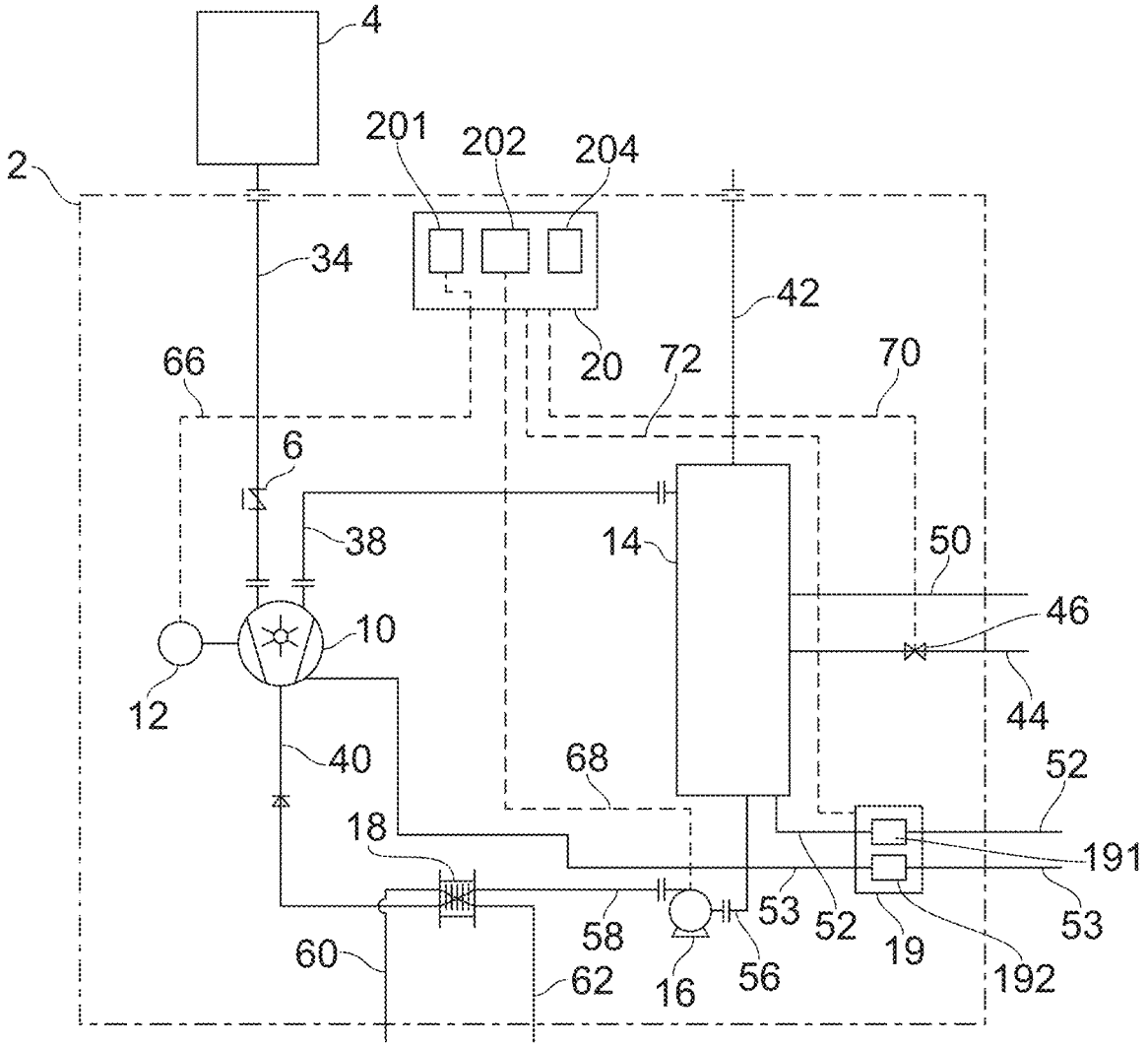
FIG. 1 is a schematic illustration (not to scale) showing a vacuum system.

FIG. 1 is a schematic illustration (not to scale) showing a vacuum system 2.

Figure 2:
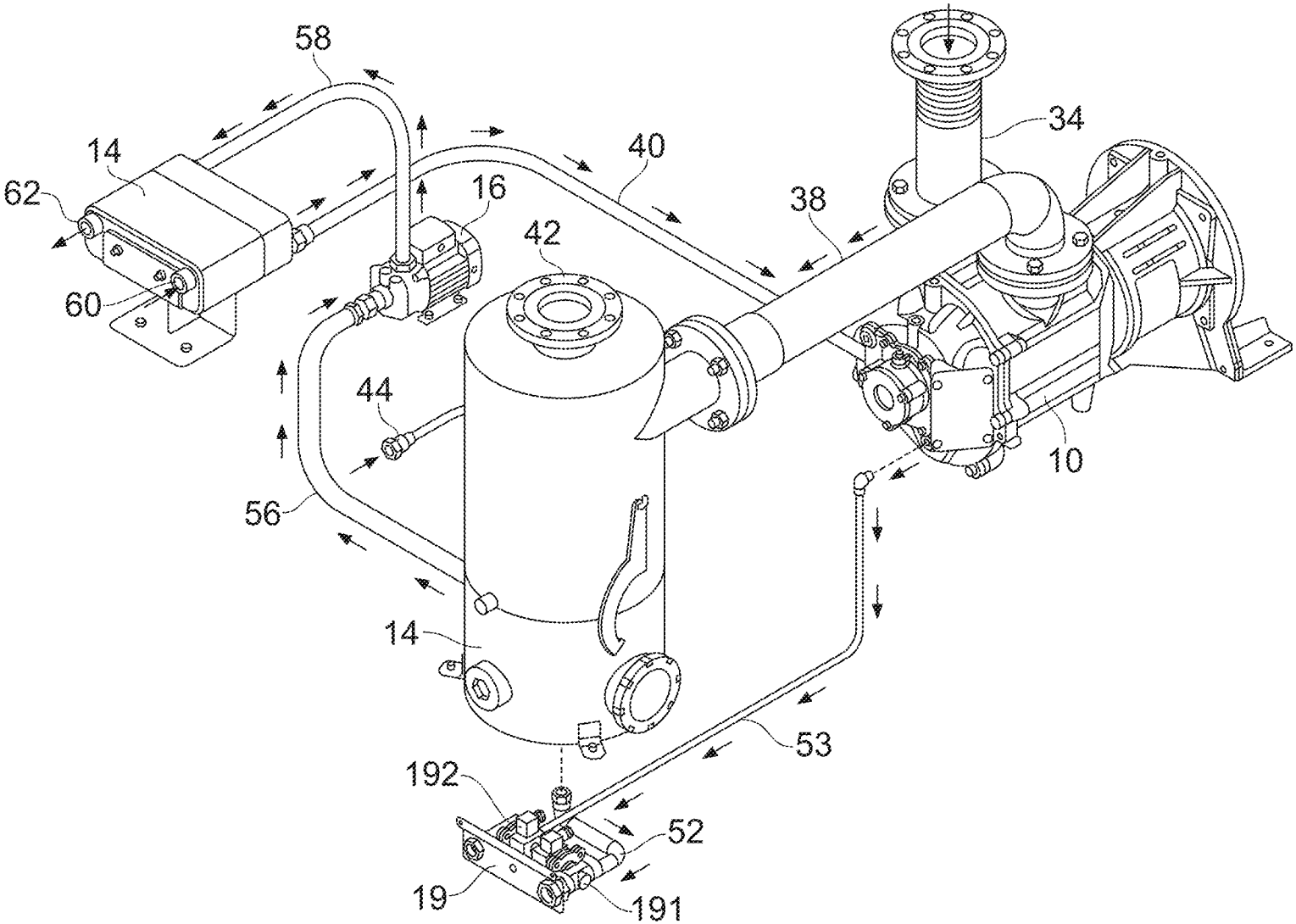
FIG. 2 is a schematic illustration (not to scale) showing a perspective view of certain components of the vacuum system.
Figure 3:
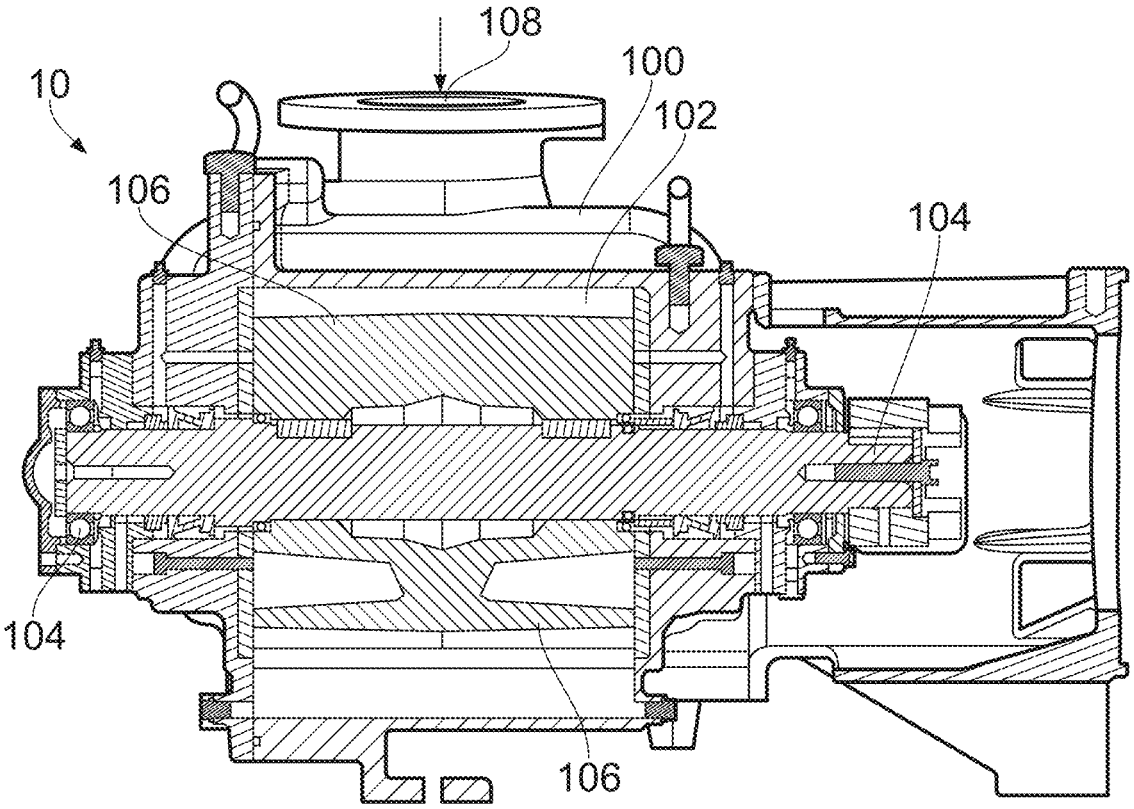
FIG. 3 is a schematic illustration (not to scale) of a liquid ring pump.

FIG. 2 is a schematic illustration (not to scale) showing a perspective view of certain components of the vacuum system 2.

The vacuum system 2 is coupled to a facility 4 such that, in operation, the vacuum system 2 establishes a vacuum or low-pressure environment at the facility 4 by drawing gas (for example, air) from the facility 4.

In this embodiment, the vacuum system 2 comprises a non-return valve 6, a liquid ring pump 10, a motor 12, a separator 14, a pump system 16, a heat exchanger 18, a valve module 19 comprising a first valve 191 and a second valve 192, and a controller 20.

The facility 4 is connected to an inlet of the liquid ring pump 10 via a suction or vacuum line or pipe 34.

The non-return valve 6 is disposed on the suction line 34. The non-return valve 6 is disposed between the facility 4 and the liquid ring pump 10.

The non-return valve 6 is configured to permit the flow of fluid (e.g. a gas such as air) from the facility 4 to the liquid ring pump 10, and to prevent or oppose the flow of fluid in the reverse direction, i.e. from the liquid ring pump 10 to the facility 4.

In this embodiment, the liquid ring pump 10 is a single-stage liquid ring pump.

A gas inlet of the liquid ring pump 10 is connected to the suction line 34. A gas outlet of the liquid ring pump 10 is connected to an exhaust line or pipe 38. The liquid ring pump 10 is coupled to the heat exchanger 18 via a first operating liquid pipe 40. The liquid ring pump 10 is configured to receive the operating liquid from the heat exchanger 18 via the first operating liquid pipe 40. The liquid ring pump 10 is driven by the motor 12. Thus, the motor 12 is a driver of the liquid ring pump 10.

FIG. 2 is a schematic illustration (not to scale) of a cross section of an example liquid ring pump 10. The remainder of the vacuum system 2 will be described in more detail later below after a description of the liquid ring pump 10 shown in FIG. 2.

In this embodiment, the liquid ring pump 10 comprises a housing 100 that defines a substantially cylindrical chamber 102, a shaft 104 extending into the chamber 102, and an impeller 106 fixedly mounted to the shaft 104. The gas inlet 108 of the liquid ring pump 10 (which is coupled to the suction line 34) is fluidly connected to a gas intake of the chamber 102. The gas outlet (not shown in FIG. 2) of the liquid ring pump 10 is fluidly connected to a gas output of the chamber 102.

During operation of the liquid ring pump 10, the operating liquid is received in the chamber 102 via the first operating liquid pipe 40. In some embodiments, operating liquid may additionally be received via the suction line 34 via a spray nozzle. Also, the shaft 104 is rotated by the motor 12, thereby rotating the impeller 106 within the chamber 102. As the impeller 106 rotates, the operating liquid in the chamber 102 (not shown in the Figures) is forced against the walls of the chamber 102 thereby to form a liquid ring that seals and isolates individual volumes between adjacent impeller vanes. Also, gas (such as air) is drawn into the chamber 102 from the suction line 34 via the gas inlet 108 and the gas intake of the chamber 102. This gas flows into the volumes formed between adjacent vanes of the impeller 106. The rotation of the impeller 106 compresses the gas contained within the volume as it is moved from the gas intake of the chamber 102 to the gas output of the chamber 102, where the compressed gas exits the chamber 102. Compressed gas exiting the chamber 102 then exits the liquid ring pump via the gas outlet and the exhaust line 38.

Returning now to the description of FIG. 1, the exhaust line 38 is coupled between the gas outlet of the liquid ring pump 10 and an inlet of the separator 14.

The separator 14 is connected to the liquid ring pump 10 via the exhaust line 38 such that exhaust fluid (i.e. compressed gas, which may include water droplets and/or vapour) is received by the separator 14. The separator 14 is configured to separate the exhaust fluid received from the liquid ring pump 10 into gas (e.g. air) and the operating liquid. Thus, the separator 14 provides for recycling of the operating liquid.

The gas separated from the received exhaust fluid is expelled from the separator 14, and the vacuum system 2, via a system outlet pipe 42.

In this embodiment, the separator 14 comprises a further inlet 44 via which the separator 14 may receive a supply of additional, or "top-up", operating liquid from an operating liquid source (not shown in the Figures). A third valve 46 is disposed along the further inlet 44. The third valve 46 is configured to control the flow of the additional operating liquid into the separator 14 via the further inlet 44. The third valve 46 may be a solenoid valve.

The separator 14 comprises three operating liquid outlets. A first operating liquid outlet of the separator 14 is coupled to the pump system 16 via a second operating liquid pipe 56 such that operating liquid may flow from the separator 14 to the pump system 16. A second operating liquid outlet of the separator 14 is coupled to an overflow pipe 50, which provides an outlet for excess operating liquid. A third operating liquid outlet of the separator 14 is coupled to a first drainage or evacuation line 52, which provides a line via which the separator 14 can be drained of operating liquid. In this embodiment, the connection between the separator 14 and the first drainage line 52 is located at or proximate to the bottom of the separator 14. Thus, operating fluid can drain out of the separator 14 via the first drainage line 52 under gravity.

The valve module 19 is coupled to the first drainage line 52. More specifically, the first valve 191 of the valve module 19 is disposed along the first drainage line 52. The first valve 191 is configured to be in either an open or closed state thereby to allow or prevent the flow of the operating liquid out of the separator 14 via the first drainage line 52, respectively. The first valve 191 may be a solenoid valve.

The valve module 19 is further coupled to the liquid ring pump 10 via a second drainage line 53. The second drainage line 53 is a line via which the chamber 102 of the liquid ring pump 10 can be drained of operating liquid. In this embodiment, the connection between the chamber 102 of the liquid ring pump 10 and the second drainage line 53 is located at or proximate to the bottom of the chamber 102. Thus, operating fluid can drain out of the chamber 102 via the second drainage line 53 under gravity.

The valve module 19 is coupled to the second drainage line 53. More specifically, the second valve 192 of the valve module 19 is disposed along the second drainage line 53. The second valve 192 is configured to be in either an open or closed state thereby to allow or prevent the flow of the operating liquid out of the chamber 102 of the liquid ring pump 10 via the second drainage line 53, respectively. The second valve 192 may be a solenoid valve.

The first valve 191 may have a greater Valve Flow Coefficient (VFC) than the second valve 192. The first valve 191 may have any appropriate pipe diameter, e.g. 12.7 mm (½ inch) to 50.8 mm (2 inches). Preferably, the first valve 191 has a pipe diameter of about 25.4 mm (1 inch). The second valve 192 may have any appropriate pipe diameter, e.g. 6.35 mm (¼ inch) to 25.4 mm (1 inch). Preferably, the second valve 192 has a pipe diameter of about 12.7 mm (½ inch).

The first drainage line 52 may have a greater pipe diameter than the second drainage line 53. The first drainage line 52 may have any appropriate pipe diameter, e.g. 12.7 mm (½ inch) to 50.8 mm (2 inches). Preferably, the first drainage line 52 has a pipe diameter of about 25.4 mm (1 inch). The second drainage line 53 may have any appropriate pipe diameter, e.g. 6.35 mm (¼ inch) to 25.4 mm (1 inch). Preferably, the second drainage line 53 has a pipe diameter of about 12.7 mm (½ inch).

In this embodiment, in addition to being coupled to the separator 14 via the second operating liquid pipe 56, the pump system 16 is coupled to the heat exchanger 18 via a third operating liquid pipe 58. The pump system 16 comprises a pump (e.g. a centrifugal pump) and a motor configured to drive that pump. The pump system 16 is configured to pump operating liquid out of the separator 14 via the second operating liquid pipe 56, and to pump that operating liquid to the heat exchanger 18 via the third operating liquid pipe 58.

The heat exchanger 18 is configured to receive relatively hot operating liquid from the pump system 16, to cool that relatively hot operating liquid to provide relatively cool operating liquid, and to output that relatively cool operating liquid.

In this embodiment, the heat exchanger 18 is configured to cool the relatively hot operating liquid flowing through the heat exchanger 18 by transferring heat from that relatively hot operating liquid to a fluid coolant also flowing through the heat exchanger 18. The operating liquid and the coolant are separated in the heat exchanger 18 by a solid wall via which heat is transferred, thereby to prevent mixing of the operating liquid with the coolant. The heat exchanger 18 receives the coolant from a coolant source (not shown in the Figures) via a coolant inlet 60. The heat exchanger 18 expels coolant (to which heat has been transferred) via a coolant outlet 62.

The heat exchanger 18 comprises an operating liquid outlet from which the cooled operating liquid flows (i.e. is pumped by the pump system 16). The operating liquid outlet is coupled to the first operating liquid pipe 40. Thus, the heat exchanger 18 is connected to the liquid ring pump 10 via the first operating liquid pipe 40 such that, in operation, the cooled operating liquid is pumped by the pump system 16 from the heat exchanger 18 to the liquid ring pump 10.

The controller 20 may comprise one or more processors. In this embodiment, the controller 20 comprises two variable frequency drives (VFD), namely a first VFD 201 and a second VFD 202. The first VFD 201 is configured to control the speed of the motor 12. The first VFD 201 may comprise an inverter for controlling the motor 12. The second VFD 202 is configured to control the speed of the motor of the pump system 16. The second VFD 202 may comprise an inverter for controlling the motor of the pump system 16.

The controller 20 is connected to the motor 12 via a first of its VFDs and via a first connection 66 such that a control signal for controlling the motor 12 may be sent from the controller 20 to the motor 12. The first connection 66 may be any appropriate type of connection including, but not limited to, an electrical wire or an optical fibre, or a wireless connection. The motor 12 is configured to operate in accordance with the control signal received by it from the controller 20.

The controller 20 is connected to the pump system 16 via a second of its VFDs and via a second connection 68 such that a control signal for controlling the pump system 16 may be sent from the controller 20 to the motor of the pump system 16. The second connection 68 may be any appropriate type of connection including, but not limited to, an electrical wire or an optical fibre, or a wireless connection. The pump system 16 is configured to operate in accordance with the control signal received by it from the controller 20.

The controller 20 is connected to the valve module 19 via a third connection 69 such that one or more control signals for controlling the first and second valves 191, 192 of the valve module 19 may be sent from the controller 20 to the valve module 19. The third connection 69 may be any appropriate type of connection including, but not limited to, an electrical wire or an optical fibre, or a wireless connection. The first valve 191 is configured to switch between its open and closed state (thereby to allow or prevent the drainage of the operating liquid from the separator 14 via the first drainage line 52, respectively) in accordance with the one or more control signals received by the valve module 19 from the controller 20. The second valve 192 is configured to switch between its open and closed state (thereby to allow or prevent the drainage of the operating liquid from the liquid ring pump 10 via the second drainage line 53, respectively) in accordance with the one or more control signals received by the valve module 19 from the controller 20. Control of the first and second valves 191, 192 by the controller 20 is described in more detail later below with reference to FIGS. 4 to 6.

In this embodiment, the controller 20 further comprises a timer 204. The timer 204 is configured to output a timer signal at a first predetermined time interval. For example, the timer 204 repeatedly outputs the timer signal every time the first predetermined time interval elapses. Said another way, in this embodiment, the timer 204 measures elapsed time from a zero point; once the first predetermined time interval has elapsed, the timer 204 outputs the timer signal and resets to zero. After resetting to zero, the timer 204 begins measuring elapsed time from that zero point once again. The first predetermined time interval may be set by a user or operator of the system 2. The timer 204 may be manually set to zero, started, stopped, or paused by a user or operator of the system 2.

The first predetermined time interval may be any appropriate interval or period. For example, the first predetermined time interval may be an interval or period of 1 hour, 2 hours, 3 hours, 4 hours, 5 hours, 6 hours, 7 hours, 8 hours, 9 hours, 10 hours, 11 hours, 12 hours, or greater than 12 hours.

In some embodiments, the controller 20 is configured to control the first and/or second valves 191, 192 dependent on the timer signal, for example responsive to the timer outputting the timer signal.

The controller 20 is connected to the third valve 46 via a fourth connection 70 such that a control signal for controlling the third valve 46 may be sent from the controller 20 to the third valve 46. The fourth connection 70 may be any appropriate type of connection including, but not limited to, an electrical wire or an optical fibre, or a wireless connection. The third valve 46 is configured to switch between its open and closed state (thereby to allow or prevent the flow of the additional operating liquid into the separator 14, respectively) in accordance with the control signal received by it from the controller 20. Control of the third valve 46 by the controller 20 is described in more detail later below with reference to FIGS. 4 to 6.

The controller 20 may be configured to operate one or more of the valves 46, 191, 192 dependent on any appropriate inputs. For example, the third valve 46 may be controlled based on measurements by a level sensor installed on the separator 14. When the level sensor measures that the level in the separator is below a low level threshold, the third valve 46 may be controlled to open to allow water to flow into the separator 14. The first and/or second valves 191, 192 may be controlled based on a timer in software. The first predetermined time interval of the timer can be adjusted by a user of the system, and may be adjusted dependent on the cleanliness of the process. For example, if process gases being pumped contain more particulate matter, the first predetermined time interval may be adjusted to be relatively short, whereas a relatively longer period can be used for cleaner processes. One or more valves may be controlled based on an element outlet temperature, e.g., by closing one or more of the valves 46, 191, 192 if the element outlet temperature exceeds a threshold temperature.

Thus, an embodiment of the vacuum system 2 is provided.

Apparatus, including the controller 20, for implementing the above arrangement, and performing the method steps to be described later below, may be provided by configuring or adapting any suitable apparatus, for example one or more computers or other processing apparatus or processors, and/or providing additional modules. The apparatus may comprise a computer, a network of computers, or one or more processors, for implementing instructions and using data, including instructions and data in the form of a computer program or plurality of computer programs stored in or on a machine-readable storage medium such as computer memory, a computer disk, ROM, PROM etc., or any combination of these or other storage media.

An embodiment of a first control process performable by the vacuum system 2 will now be described with reference to FIG. 4.

Figure 4:
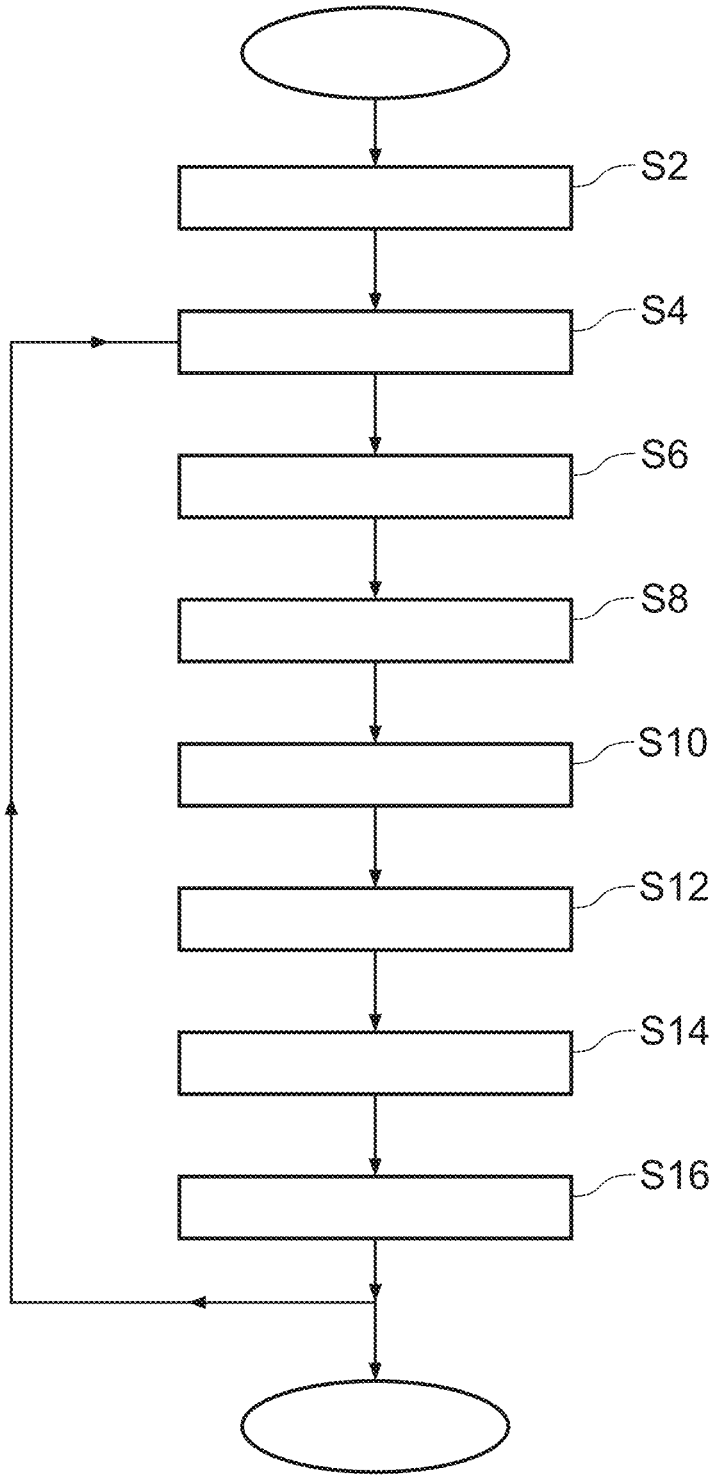
FIG. 4 is a process flow chart showing certain steps of a first process performable by the vacuum system.

FIG. 4 is a process flow chart showing certain steps of an embodiment of a first control process that may be implemented by the vacuum system 2.

At step s2, the controller 20 controls the motor 12 to cause the liquid ring pump 10 to pump gas from the facility 4. In other words, the controller 20 controls the motor 12 such that the liquid ring pump 10 is "on" or active.

At step s4, the timer 204 measures the first predetermined time interval. The first predetermined time interval may be measured from any appropriate "zero point" in time, such as a point at which the liquid ring pump 10 or motor 12 was switched "on".

At step s6, responsive to the first predetermined time interval elapsing, the timer 204 outputs a timer signal. After outputting the timer signal, the timer 204 resets to zero, and begins measuring the first predetermined time interval from that zero point.

At step s8, while the liquid ring pump 10 is "on" or active, responsive to the timer 204 outputting the timer signal, the controller 20 controls the first valve 191 to open.

At step s10, as a result of the first valve 191 being opened, the operating liquid within the separator 14 flows out of the separator 14 via the first drainage line 52. The operating liquid within the separator 14 may flow out of the separator 14 under gravity. Thus, operating fluid that may be contaminated, for example by particulate matter, is removed from the system 2.

At step s12, responsive to the first valve 191 having been opened for a second predetermined time interval, the controller 20 controls the first valve 191 to close. Thus, the operating liquid within the separator 14 is prevented from flowing out of the separator 14 via the first drainage line 52.

The second predetermined time interval is preferably shorter than the first predetermined time interval. The second predetermined time interval may be, for example, between about 10 secs and about 300 secs, or more preferably between about 100 secs and about 200 secs, or more preferably about 140 secs. This ensures that the first valve 191 is closed before being opened again responsive to a subsequent first predetermined time interval elapsing.

In some embodiments, the second predetermined time interval is measured by the timer 204. The timer 204 may be configured to output a second timer signal responsive to the second predetermined time interval elapsing. The controller 20 may be configured to control (e.g. close) the first valve 191 responsive to the second timer signal being output by the timer 204. Alternatively, the system may comprise a second timer for measuring the second predetermined time interval.

The second predetermined time interval may be set by a user or operator of the system 2.

In some embodiments, the controller 20 may control the first valve 191 to close if the operating liquid level in the separator becomes too low, i.e. reaches or drops below a lower threshold level.

At step s14, while the liquid ring pump 10 is "on" or active, the controller 20 controls the third valve 46 to open.

The third valve 46 may be opened dependent on or responsive to the timer 204 outputting the timer signal. The third valve 46 may be opened dependent on or responsive to the first valve 191 being opened. For example, the controller 20 may open the third valve 46 at the same time as it opens the first valve 191. Alternatively, the controller 20 may open the third valve 46 at some predetermined amount of time after it opens the first valve 191.

At step s16, as a result of the third valve 46 being opened, additional, or "top-up", operating liquid flows into the separator 14 from the operating liquid source via further inlet 44.

The third valve 46 may be controlled based on the state of the first valve 191. For example, the third valve 46 may be opened when the first valve 191 is opened, or a predetermined time period from the first valve 191 being opened. Similarly, the third valve 46 may be closed when the first valve 191 is closed, or a predetermined time period from the first valve 191 being closed.

The third valve 46 may be controlled based on the level of operating liquid in the separator 14. For example, the third valve 46 may be controlled to maintain the level of operating liquid in the separator 14 at a predetermined level.

After step s16, the process returns to step s4, with the timer 204 measuring the first predetermined time interval from a "zero point" which may correspond to the time at which the timer 204 was reset to zero.

The process of FIG. 4 may be stopped or paused at any point during said process. This may be performed by the user, e.g. inputting a "stop" command into the controller 20. Stopping the process of FIG. 4 may, for example cause the valves 46, 191, 192 to be closed and/or the liquid ring pump 10 to be deactivated or stopped.

Thus, an embodiment of a first control process is provided.

An embodiment of a second control process performable by the vacuum system 2 will now be described with reference to FIG. 5.

Figure 5:
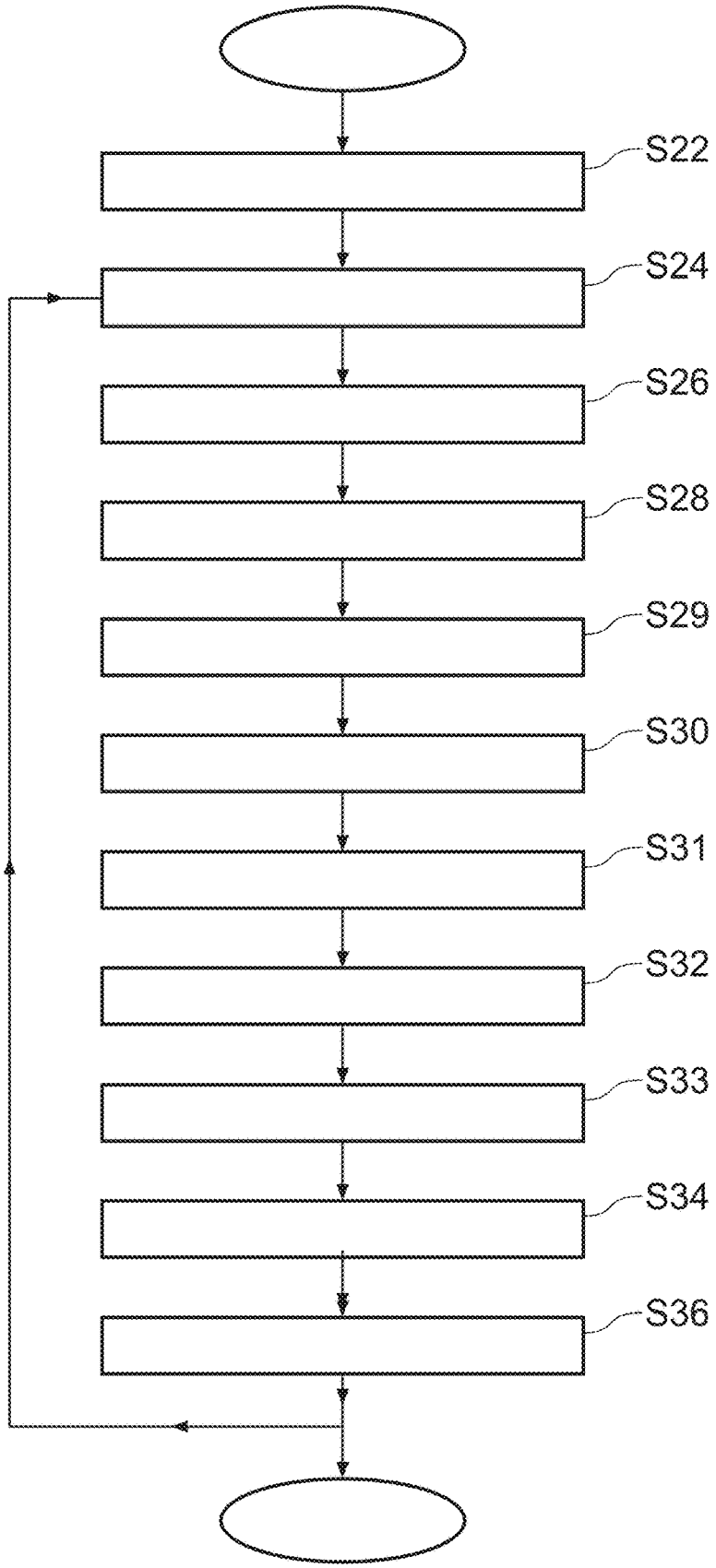
FIG. 5 is a process flow chart showing certain steps of a second process performable by the vacuum system.

FIG. 5 is a process flow chart showing certain steps of an embodiment of a second control process that may be implemented by the vacuum system 2.

At step s22, the controller 20 controls the motor 12 to cause the liquid ring pump 10 not to pump gas from the facility 4. In other words, the controller 20 controls the motor 12 such that the liquid ring pump 10 is "off" or inactive. The liquid ring pump 10 may be considered to be in standby-mode.

At step s24, the timer 204 measures the first predetermined time interval. The first predetermined time interval may be measured from any appropriate "zero point" in time, such as a point at which the liquid ring pump 10 or motor 12 was switched "off".

At step s26, responsive to the first predetermined time interval elapsing, the timer 204 outputs a timer signal. After outputting the timer signal, the timer 204 resets to zero, and begins measuring the first predetermined time interval from that zero point.

At step s28, while the liquid ring pump 10 is "off" or inactive, responsive to the timer 204 outputting the timer signal, the controller 20 controls the first valve 191 to open.

At step s29, while the liquid ring pump 10 is "off" or inactive, responsive to the timer 204 outputting the timer signal, the controller 20 controls the second valve 192 to open.

At step s30, as a result of the first valve 191 being opened, the operating liquid within the separator 14 flows out of the separator 14 via the first drainage line 52. The operating liquid within the separator 14 may flow out of the separator 14 under gravity. Thus, operating fluid, that may be contaminated, for example by particulate matter, is removed from the system 2.

At step s31, as a result of the second valve 192 being opened, the operating liquid within the liquid ring pump 10 flows out of the liquid ring pump 10 via the second drainage line 53. The operating liquid within the liquid ring pump 10 may flow out of the liquid ring pump 10 under gravity. Thus, operating fluid, that may be contaminated, for example by particulate matter, is removed from the system 2.

At step s32, responsive to the first valve 191 having been opened for a second predetermined time interval, the controller 20 controls the first valve 191 to close. Thus, the operating liquid within the separator 14 is prevented from flowing out of the separator 14 via the first drainage line 52.

The second predetermined time interval is preferably shorter than the first predetermined time interval. The second predetermined time interval may be, for example, about 10 secs and about 300 secs, or more preferably between about 100 secs and about 200 secs, or more preferably between about 140 secs. This ensures that the first valve 191 is closed before being opened again responsive to a subsequent first predetermined time interval elapsing.

In some embodiments, the second predetermined time interval is measured by the timer 204. The timer 204 may be configured to output a further timer signal responsive to the second predetermined time interval elapsing. The controller 20 may be configured to control (e.g. close) the first valve 191 responsive to the second timer signal being output by the timer 204. Alternatively, the system may comprise a further timer for measuring the second predetermined time interval.

In some embodiments, the controller 20 may control the first valve 191 to close if the operating liquid level in the separator 14 becomes too low, i.e. reaches or drops below a lower threshold level.

At step s33, responsive to the second valve 192 having been opened for a third predetermined time interval, the controller 20 controls the second valve 192 to close. Thus, the operating liquid within the liquid ring pump 10 is prevented from flowing out of the liquid ring pump 10 via the second drainage line 53.

The third predetermined time interval is preferably shorter than the first predetermined time interval. The third predetermined time interval may be, for example, between about 10 secs and about 500 secs, or more preferably between about 100 secs and about 400 secs, or more preferably between about 200 secs and about 300 secs, or more preferably about 240 secs. This ensures that the second valve 192 is closed before being opened again responsive to a subsequent first predetermined time interval elapsing.

In some embodiments, the third predetermined time interval is measured by the timer 204. The timer 204 may be configured to output a second further timer signal responsive to the third predetermined time interval elapsing. The controller 20 may be configured to control (e.g. close) the second valve 192 responsive to the second further timer signal being output by the timer 204. Alternatively, the system may comprise a second further timer for measuring the second predetermined time interval.

The second predetermined time interval may be set by a user or operator of the system 2. The third predetermined time interval may be set by a user or operator of the system 2.

In some embodiments, the controller 20 may control the second valve 192 to close if the operating liquid level in the liquid ring pump 10 becomes too low, i.e. reaches or drops below a lower threshold level.

In this embodiment, the controller 20 controls the first and second valves 191, 192 to close (e.g. immediately) if the state of the liquid ring pump 10 changes from "off" or "inactive, to "preparing to start".

In this embodiment, at steps s28 to s33 both the first and second valves 191, 192 are opened and subsequently closed. The valves 191, 192 may be opened at least overlapping to some extent temporally, or temporally sequentially. Preferably, both the first and second valves 191, 192 are opened at the same time thereby to provide for faster draining of the system 2. However, in other embodiments, only one of the first or second valves 191, 192 is opened and subsequently closed.

At step s34, the controller 20 controls the third valve 46 to open. The third valve 46 may be opened while the liquid ring pump 10 is "off" or "preparing to start". The third valve 46 may be opened while the first and/or second valves 191, 192 are open, or when one or both of the first or second valves 191, 192 has been closed.

The third valve 46 may be opened dependent on or responsive to the timer 204 outputting the timer signal. The third valve 46 may be opened dependent on or responsive to the first valve 191 and/or second valve 192 being opened. For example, the controller 20 may open the third valve 46 at the same time as it opens the first valve 191 and/or second valve 192. The controller 20 may open the third valve 46 at some predetermined amount of time after it opens the first valve 191. The controller 20 may open the third valve 46 at some predetermined amount of time after it opens the second valve 192.

At step s36, as a result of the third valve 46 being opened, additional, or "top-up", operating liquid flows into the separator 14 from the operating liquid source via further inlet 44.

The third valve 46 may be controlled based on the state of the first valve 191. For example, the third valve 46 may be opened when the first valve 191 is opened, or a predetermined time period from the first valve 191 being opened. Similarly, the third valve 46 may be closed when the first valve 191 is closed, or a predetermined time period from the first valve 191 being closed.

The third valve 46 may be controlled based on the state of the second valve 192. For example, the third valve 46 may be opened when the second valve 192 is opened, or a predetermined time period from the second valve 192 being opened. Similarly, the third valve 46 may be closed when the second valve 192 is closed, or a predetermined time period from the second valve 192 being closed.

The third valve 46 may be controlled based on the level of operating liquid in the separator 14. For example, the third valve 46 may be controlled to maintain the level of operating liquid in the separator 14 at a predetermined level.

After step s36, the process returns to step s24, with the timer 204 measuring the first predetermined time interval from a "zero point" which may correspond to the time at which the timer 204 was reset to zero. Alternatively, after step s36, the process may end.

The process of FIG. 5 may be stopped or paused at any point during said process. This may be performed by the user, e.g. inputting a "stop" command into the controller 20. Stopping the process of FIG. 5 may, for example cause the valves 46, 191, 192 to be closed and/or the liquid ring pump 10 to be deactivated or stopped.

Thus, an embodiment of a second control process is provided.

An embodiment of a third control process performable by the vacuum system 2 will now be described with reference to FIG. 6.

Figure 6:
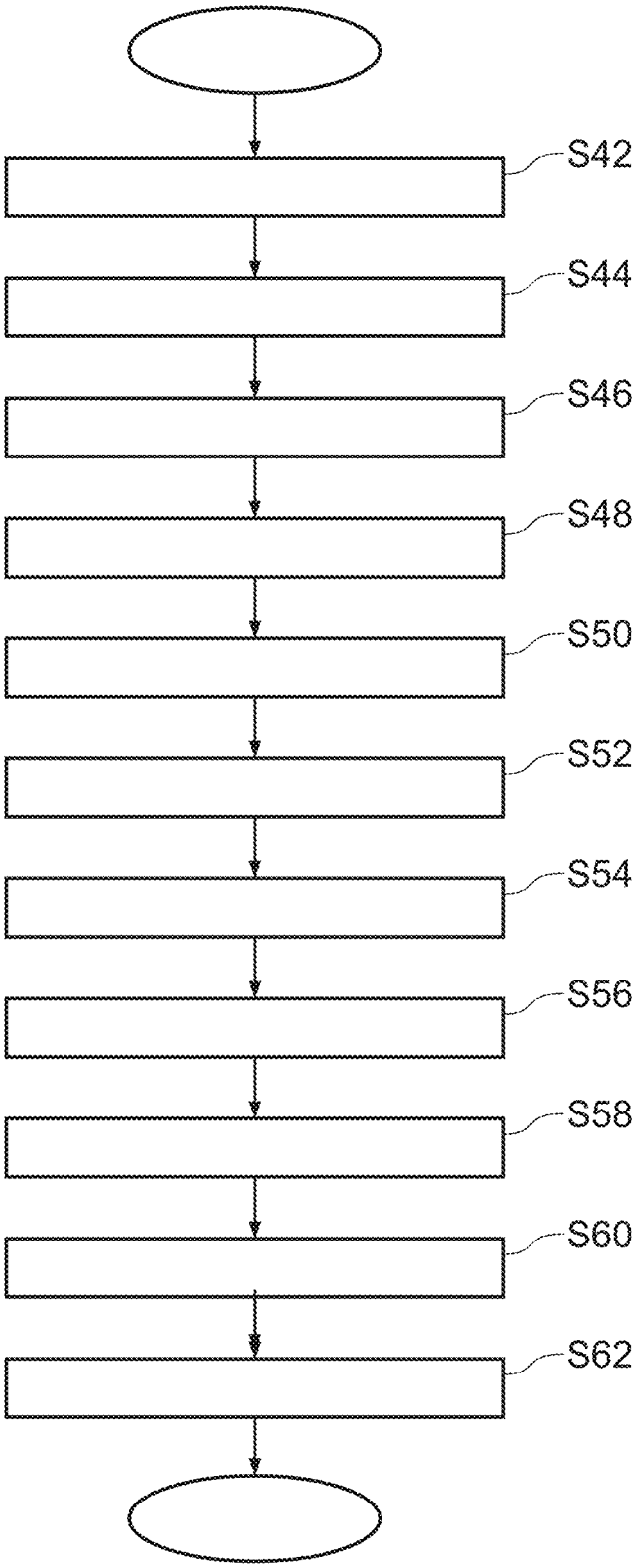
FIG. 6 is a process flow chart showing certain steps of a third process performable by the vacuum system.

FIG. 6 is a process flow chart showing certain steps of an embodiment of a first control process that may be implemented by the vacuum system 2.

At step s42, the controller 20 controls the motor 12 to cause the liquid ring pump 10 not to pump gas from the facility 4. In other words, the controller 20 controls the motor 12 such that the liquid ring pump 10 is "off" or inactive. The liquid ring pump 10 may be considered to be in standby-mode.

At step s44, the controller 20 controls the first valve 191 to open.

At step s46, as a result of the first valve 191 being opened, the operating liquid within the separator 14 flows out of the separator 14 via the first drainage line 52. The operating liquid within the separator 14 may flow out of the separator 14 under gravity. Thus, operating fluid, that may be contaminated, for example by particulate matter, is removed from the system 2.

At step s48, the controller 20 controls the second valve 192 to open.

At step s50, as a result of the second valve 192 being opened, the operating liquid within the liquid ring pump 10 flows out of the liquid ring pump 10 via the second drainage line 53. The operating liquid within the liquid ring pump 10 may flow out of the liquid ring pump 10 under gravity. Thus, operating fluid, that may be contaminated, for example by particulate matter, is removed from the system 2.

At step s52, responsive to a predetermined amount of operating liquid being drained from the system 2 (for example, substantially all of the operating liquid), the controller 20 controls the first and second valves 191, 192 to close.

In this embodiment, at steps s44 to s52 both the first and second valves 191, 192 are opened and subsequently closed. The opening of the valves 191, 192 may at least to some extent overlap temporally, or may occur temporally sequentially. Preferably, both the first and second valves 191, 192 are opened at the same time thereby to provide for faster draining of the system 2. However, in other embodiments, only one of the first or second valves 191, 192 is opened and subsequently closed.

At step s54, the controller 20 controls the third valve 46 to open.

At step s56, as a result of the third valve 46 being opened, additional, or "top-up", operating liquid flows into the separator 14 from the operating liquid source via further inlet 44.

The third valve 46 may be controlled based on the level of operating liquid in the separator 14. For example, the third valve 46 may be controlled to refill the system 2 with operating liquid, for example, until the level of operating liquid in the separator 14 reaches a predetermined level.

During the refilling of the system 2 with the operating liquid, the pumping system 16 may be controlled to pump the operating liquid around the system 2. The centrifugal pump of the pumping system 16 may be operated at its maximum speed.

During or after the refilling of the system 2 with the operating liquid, the liquid ring pump may be turned "on". The liquid ring pump 10 may be controlled to operate at a relatively low speed. During this, the non-return valve 6 is closed. Also, an air bleed valve of the liquid ring pump 10 is opened. This avoids a vacuum being generated.

At step s58, responsive to the system 2 being refilled with operating liquid, to a predetermined desired level, the controller 20 controls the third valve 46 to close.

At step s60, responsive to the system 2 being refilled with operating liquid, steps s42 to s58 described above are perform one or more further times. Preferably, the process of steps s42 to s58 is performed a total of at least two times.

At step s62, the system 2 is operated in its normal operating mode, and the controller 20 controls the motor 12 to cause the liquid ring pump 10 to pump gas from the facility 4. In other words, the controller 20 controls the motor 12 such that the liquid ring pump 10 is "on" or active.

The process of FIG. 6 may be stopped or paused at any point during said process. This may be performed by the user, e.g. inputting a "stop" command into the controller 20. Stopping the process of FIG. 6 may, for example cause the valves 46, 191, 192 to be closed and/or the liquid ring pump 10 to be deactivated or stopped.

Thus, an embodiment of a third control process is provided.

Advantageously, the above-described systems and methods provide for cleaning of the systems, including the liquid ring pump. The system is cleaned by flushing with operating liquid to remove built up particulate matter and contaminated operating liquid.

The above-described systems and methods provide for renewal and refreshing of operating liquid. The preventive renewal of service liquid in the system, and the removal or flushing of contaminants advantageously tends to improve reliability and expected lifetime on all contamination sensitive parts of the system, such as the liquid ring pump, the heat exchanger, mechanical seals, the centrifugal pump, spray nozzles, etc.

The above-described methods may be performed automatically, under control of the controller.

It should be noted that certain of the process steps depicted in the flowchart of FIGS. 4 to 6 and described above may be omitted or such process steps may be performed in differing order to that presented above and shown in FIGS. 4 to 6. Furthermore, although all the process steps have, for convenience and ease of understanding, been depicted as discrete temporally-sequential steps, nevertheless some of the process steps may in fact be performed simultaneously or at least overlapping to some extent temporally.

In the above embodiments, the vacuum system comprises the elements described above with reference to FIG. 1. However, in other embodiments the vacuum system comprises other elements instead of or in addition to those described above. Also, in other embodiments, some or all of the elements of the vacuum system may be connected together in a different appropriate way to that described above. For example, in some embodiments, multiple liquid ring pumps may be implemented.

In the above embodiments, the non-return valve and the liquid ring pump are separate, individual devices. However, in some embodiments, the liquid ring pump may have an integrated non-return valve, e.g. in the inlet manifold of the liquid ring pump.

In the above embodiments, the heat exchanger cools the operating liquid flowing therethrough. However, in other embodiments other cooling means are implemented to cool the operating liquid prior to it being received by the liquid ring pump, instead of or in addition to the heat exchanger.

In the above embodiments, the liquid ring pump is a single-stage liquid ring pump. However, in other embodiments the liquid ring pump is a different type of liquid ring pump, for example a multi-stage liquid ring pump.

In the above embodiments, the operating liquid is water. However, in other embodiments, the operating liquid is a different type of operating liquid, e.g. an oil.

The controller may be a proportional-integral (PI) controller, a proportional (P) controller, an integral (I) controller, a derivative (D) controller, a proportional-derivative (PD) controller, a proportional-integral-derivative controller (PID) controller, a fuzzy logic controller, or any other type of controller.

In the above embodiments, a single controller controls operation of multiple system elements (e.g. the motors and the valves). However, in other embodiments multiple controllers may be used, each controlling a respective subset of the group of elements.

In the above embodiments, the pump is controlled to regulate or modulate flow of the operating liquid into the liquid ring pump. However, in other embodiments, one or more different type of regulating device is implemented instead of or in addition to the pump, for example one or more valves for controlling a flow of operating fluid. The controller may be configured to control operation of the one or more regulating devices. In some embodiments, the operating liquid flow is not modulated or regulated, and is drawn by the pump's vacuum inlet pressure.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A system comprising:

a liquid ring pump comprising:
- a chamber;
- a suction inlet; and
- an exhaust outlet; wherein
- the liquid ring pump is configured to:
  - pump an inlet fluid into the chamber via the suction inlet; and
  - pump an exhaust fluid out of the chamber via the exhaust outlet;

a separator coupled to the exhaust outlet of the liquid ring pump and configured to separate the exhaust fluid received from the liquid ring pump into gas and liquid;

a valve module, wherein:
- the valve module is coupled to the separator via a first drainage line;
- the valve module is coupled to the liquid ring pump via a second drainage line; and
- the valve module comprises:
  - a first valve arranged along the first drainage line; and
  - a second valve arranged along the second drainage line;

a timer configured to output a timer signal at a first predetermined time interval; and a controller configured to:
- while the liquid ring pump is pumping the exhaust fluid to the separator, responsive to the timer outputting the timer signal, control the first valve such that a liquid within the separator is permitted to flow out of the separator via the first drainage line for a second predetermined time interval, the second predetermined time interval being shorter than the first predetermined time interval; and
- for some time while the liquid ring pump is not pumping the exhaust fluid to the separator, either or both of:
  - control the first valve such that a liquid within the separator is permitted to flow out of the separator via the first drainage line; or
  - control the second valve such that a liquid within the liquid ring pump is permitted to flow out of the liquid ring pump via the second drainage line.

2. The system of claim 1, further comprising:

a liquid inlet line coupled to the separator via which a liquid can be introduced into the separator; and a third valve arranged along the liquid inlet line.

3. The system of claim 2, wherein the controller is further configured to, for some time while the liquid ring pump is pumping the exhaust fluid to the separator and the first valve is being controlled such that the liquid within the separator is permitted to flow out of the separator via the first drainage line, control the third valve such that liquid is permitted to flow into the separator via the liquid inlet line.

4. The system of claim 2, wherein the controller is further configured to, for some time while the liquid ring pump is not pumping the exhaust fluid to the separator, control the third valve such that liquid is permitted to flow into the separator via the liquid inlet line.

5. The system of claim 1, further comprising:

a further pump coupled between the separator and the liquid ring pump and configured to pump liquid from the separator to the liquid ring pump; wherein the controller is further configured to control the further pump.

6. The system of claim 1, wherein one or both of the first valve or the second valve is a solenoid valve.

7. The system of claim 1, wherein the first valve has a greater Valve Flow Coefficient than the second valve.

8. A control method for a system, the system comprising a liquid ring pump comprising a chamber, a suction inlet, and an exhaust outlet, the liquid ring pump being configured to pump an inlet fluid into the chamber via the suction inlet and pump an exhaust fluid out of the chamber via the exhaust outlet, a separator coupled to the exhaust outlet of the liquid ring pump and configured to separate the exhaust fluid received from the liquid ring pump into gas and liquid, and a valve module, the valve module being coupled to the separator via a first drainage line and to the liquid ring pump via a second drainage line, the valve module comprising a first valve arranged along the first drainage line and a second valve arranged along the second drainage line, a timer configured to output a timer signal at a first predetermined time interval the method comprising:

while the liquid ring pump is pumping the exhaust fluid to the separator, responsive to the timer outputting the timer signal, controlling, by a controller, the first valve such that a liquid within the separator is permitted to flow out of the separator via the first drainage line for a second predetermined time interval, the second predetermined time interval being shorter than the first predetermined time interval.

9. The method of claim 8, further comprising, while the liquid ring pump is pumping the exhaust fluid to the separator, more than one time sequentially performing steps (i) to (iii) wherein:

step (i) comprises outputting, by the timer, the timer signal responsive to the first predetermined time interval elapsing;

step (ii) comprises, responsive to the timer outputting the timer signal, controlling, by the controller, the first valve thereby to cause the liquid within the separator to flow out of the separator via the first drainage line for the second predetermined time interval; and step (iii) comprises responsive to the second predetermined time interval elapsing, controlling, by the controller, the first valve thereby to prevent the liquid within the separator from flowing out of the separator via the first drainage line.

10. The method of claim 8, wherein:

the system further comprises a liquid inlet line coupled to the separator via which a liquid can be introduced into the separator, and a third valve arranged along the liquid inlet line; and the method further comprises, for some time while the liquid ring pump is pumping the exhaust fluid to the separator and the first valve is being controlled such that the liquid within the separator is permitted to flow out of the separator via the first drainage line, controlling, by the controller, the third valve thereby to cause liquid to flow into the separator via the liquid inlet line.

11. A control method for a system, the system comprising a liquid ring pump comprising a chamber, a suction inlet, and an exhaust outlet, the liquid ring pump being configured to pump an inlet fluid into the chamber via the suction inlet and pump an exhaust fluid out of the chamber via the exhaust outlet, a separator coupled to the exhaust outlet of the liquid ring pump and configured to separate the exhaust fluid received from the liquid ring pump into gas and liquid, and a valve module, the valve module being coupled to the separator via a first drainage line and to the liquid ring pump via a second drainage line, the valve module comprising a first valve arranged along the first drainage line and a second valve arranged along the second drainage line, a timer configured to output a timer signal at a first predetermined time interval the method comprising:

while the liquid ring pump is pumping the exhaust fluid to the separator, responsive to the timer outputting the timer signal, controlling, by a controller, the first valve such that a liquid within the separator is permitted to flow out of the separator via the first drainage line for a second predetermined time interval, the second predetermined time interval being shorter than the first predetermined time interval for some time while the liquid ring pump is not pumping the exhaust fluid to the separator, performing one or more actions selected from the group of actions consisting of:

controlling, by the controller, the first valve thereby causing a liquid within the separator to flow out of the separator via the first drainage line; and controlling, by the controller, the second valve thereby to cause a liquid within the liquid ring pump to flow out of the liquid ring pump via the second drainage line.

12. The method of claim 11, wherein:

the system further comprises a liquid inlet line coupled to the separator via which a liquid can be introduced into the separator, a third valve arranged along the liquid inlet line, and a further pump coupled between the separator and the liquid ring pump; and the method further comprises, for some time while the liquid ring pump is not pumping the exhaust fluid to the separator, subsequent to the performing of the one or more actions:

responsive to one or more criteria being satisfied, controlling, by the controller, the first valve to prevent liquid within the separator from flowing out of the separator via the first drainage line and controlling, by the controller, the second valve to prevent a liquid within the liquid ring pump from flowing out of the liquid ring pump via the second drainage line;

controlling, by the controller, the third valve thereby to cause liquid to flow into the separator via the liquid inlet line; and controlling, by the controller, the further pump to pump the liquid from the separator to the liquid ring pump.

13. The method of claim 12, wherein the one or more criteria are selected from the group of criteria consisting of:

a first predetermined volume of water having flowed out of the separator via the first drainage line;

a second predetermined volume of water having flowed out of the liquid ring pump via the second drainage line;

a third predetermined volume of water having flowed out of the separator and the liquid ring pump via the first and second drainage lines;

the first valve having been opened for a first predetermined time period;

the second valve having been opened for a second predetermined time period;

the first valve and the second valve having been opened at the same time for a third predetermined time period.

* * * * *